United States Patent [19]

Olsen

[11] Patent Number: 4,460,204

[45] Date of Patent: Jul. 17, 1984

[54] DOOR HANDLE ASSEMBLY HAVING A MECHANISM FOR PREVENTING INADVERTENT LOOSENING OF THE HANDLE

[75] Inventor: Per Olsen, Bagsvaerd, Denmark

[73] Assignee: Carl F. Petersen I/S, Valby, Denmark

[21] Appl. No.: 389,983

[22] Filed: Jun. 18, 1982

[30] Foreign Application Priority Data

Jun. 26, 1981 [DK] Denmark ..... 2842/81

[51] Int. Cl.[3] ..... E05B 3/06

[52] U.S. Cl. ..... 292/356; 16/114 R; 16/DIG. 24; 16/DIG. 27; 16/DIG. 40; 292/353; 292/357

[58] Field of Search ..... 16/112, 114 R, 123, 16/126, DIG. 24, DIG. 25, DIG. 27, DIG. 30, DIG. 40, DIG. 41; 292/352, 353, 356, 357; 403/26

[56] References Cited

U.S. PATENT DOCUMENTS

| | | | |
|---|---|---|---|
| 477,836 | 6/1892 | Doebler et al. | 292/352 |
| 745,568 | 12/1903 | Caley | 292/356 |
| 843,047 | 2/1907 | Voight | 292/356 |
| 1,471,126 | 10/1923 | Hart | 292/356 |
| 2,027,608 | 1/1936 | Moller | 292/356 X |
| 2,783,075 | 2/1957 | Manuel et al. | 292/353 |
| 3,190,684 | 6/1965 | Russell | 292/356 X |

FOREIGN PATENT DOCUMENTS

| | | | |
|---|---|---|---|
| 63844 | 3/1968 | Australia | 292/356 |
| 1036704 | 8/1958 | Fed. Rep. of Germany | 292/356 |

*Primary Examiner*—Fred A. Silverberg
*Attorney, Agent, or Firm*—Finnegan, Henderson, Farabow, Garrett & Dunner

[57] ABSTRACT

In a door handle assembly (1), by which a door handle (2) is journalled through a ball bearing (5) with respect to a mounting plate (8) secured on a door (10), the inner race (6) of the ball bearing being secured in the inner end of the door handle (2), the door handle (2) is directly connected to the inner race (6) by means of a threaded connection (3, 4), a bayonet coupling or the like, and is secured against rotation with respect to the inner race (6) by means of the door handle pin (14), which is passed through a mating hole (13) in a plate or a locking ring (11) which is secured to the inner race (6).

3 Claims, 3 Drawing Figures

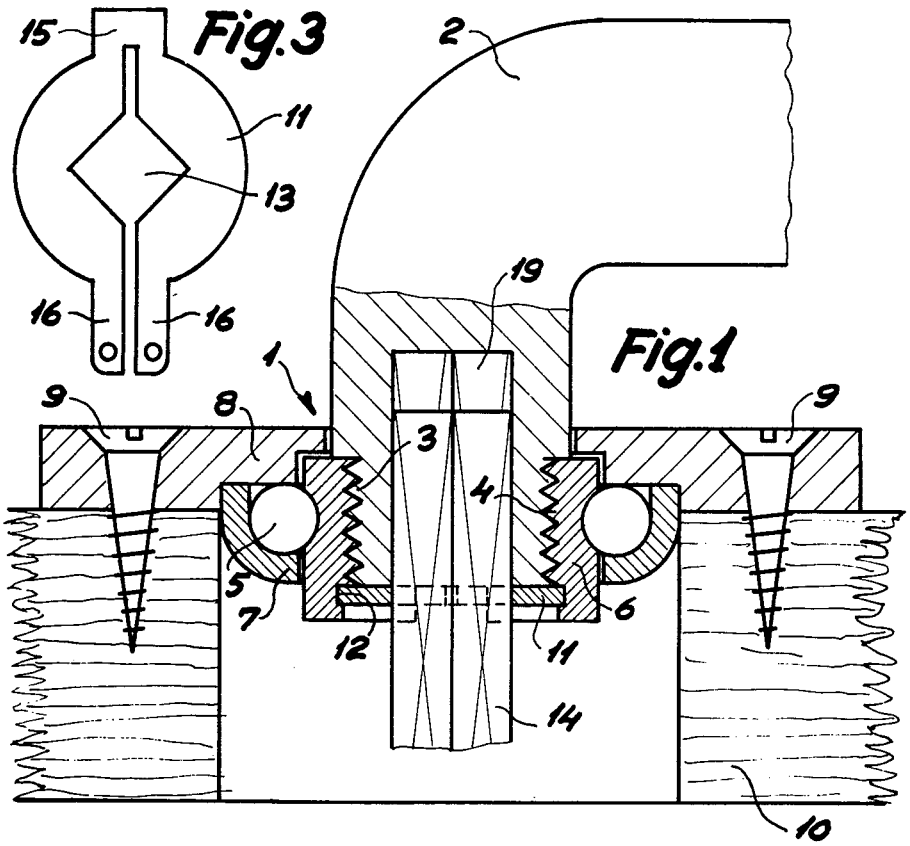
Fig.3
15
11
13
16
16
Fig.1
2
19
1
9
8
3
4
9
5
7
6
12
11
14
10
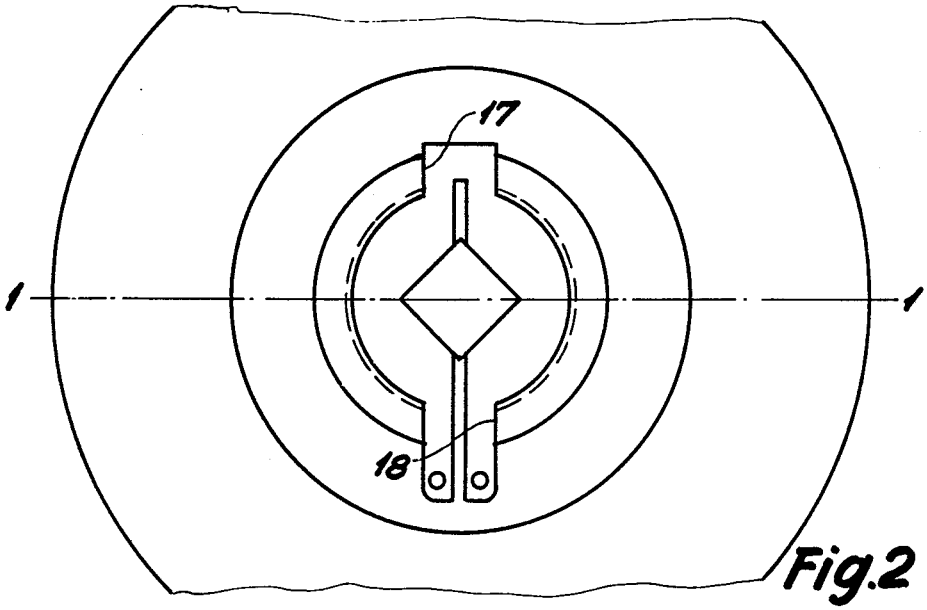
17
1
1
18
Fig.2

DOOR HANDLE ASSEMBLY HAVING A MECHANISM FOR PREVENTING INADVERTENT LOOSENING OF THE HANDLE

BACKGROUND OF THE INVENTION

1. Field of the Invention

The invention relates to a door handle assembly in which a door handle is pivoted in a mounting plate, e.g. a door handle rosette or a door plate, through a ball bearing, the outer race of the ball bearing being firmly connected to the mounting plate, and the inner race of the ball bearing being connected to the door handle whose inner end is formed with an external thread.

2. Description of the Prior Art

The specification of the GM No. 79 33 981 discloses such a door handle assembly in which a threaded flanged sleeve is passed through the inner race of the ball bearing and screwed on to the external thread of the door handle, to thereby fix the inner race between a shoulder on the door handle and the flange of the threaded sleeve. To provide for the additional, necessary securing of the inner race against rotation with respect to the door handle, a bushing of plastic is inserted between the threaded sleeve and the inner race.

However, in spite of these measures the screw connection between the threaded sleeve and the door handle can nevertheless work loose so that the door handle falls off. To remount the door handle, the mounting plate has to be unscrewed from the door and the whole door handle assembly removed.

SUMMARY OF THE INVENTION

The object of the invention is to provide a door handle assembly of the stated type in which the screw connection securing the door handle does not inadvertently work loose This object is achieved in that the door handle assembly stated above is so constructed that the inner race of the ball bearing has an internal thread corresponding to the external thread of the door handle and is arranged to be slidable, but not rotatable with respect to a door handle pin connecting the internal and external door handles. The inner race is thus secured against rotation with respect to the door handle pin, which in turn is secured in a known manner against rotation with respect to the door handle.

When the inner race of the ball bearing is firmly connected to a fixing plate having a non-circular, mating hole for the door handle pin, the inner race will be secured against rotation with respect to the door handle pin with the plate, which does not have to be particularly massive as the forces applied to it are small.

A preferred construction of the fixing plate, which permits easy mounting of the plate in the inner race, is one in which the inner race of the ball bearing has an annular track in the inner wall and the plate is formed as a locking ring or circlip with grooves in the inner race.

BRIEF DESCRIPTION OF THE DRAWING

The invention will be described more fully below with reference to the drawing, in which FIG. 1 is a section taken along the line 1—1 in FIG. 2 of a door handle assembly according to the invention, mounted on a door, FIG. 2 shows the door handle assembly as seen from the side facing a door, and FIG. 3 shows an embodiment of the plate used in the door handle assembly.

DESCRIPTION OF THE PREFERRED EMBODIMENT

The drawing shows a door handle assembly 1 with a door handle 2 whose inner end is formed with an external thread 3, which is screwed into an internal thread 4 in the inner race 6 of a ball bearing 5.

The outer race 7 of the ball bearing 5 is suitably connected to a mounting plate 8, which is secured on a door 10 by means of screws 9. The outer race may e.g. be riveted or welded on the mounting plate 8.

A fixing plate preferably having the form of a locking ring 11, the construction of which is shown in FIG. 3, is inserted in a track 12 in the inner race 6. The locking ring has an opening or a mating hole 13 through which a door handle pin 14 can be passed, but not rotated with respect to the mating hole 13. The locking ring 11 has moreover projections 15 and 16 for engagement with grooves 17 and 18, respectively, in the end of the inner race 6 which is innermost with respect to the door 10.

When the door handle 2 has been screwed suitably far into the threads 4 of the inner race and the locking ring 11 has been positioned in the track 12 in the inner race 6, the door handle pin 14 is passed through the mating hole 13 in the locking ring 11 and into the mating hole 19 for the door handle pin in the door handle 2. Then the door handle assembly 1 is mounted in the door 10 by means of the screws 9 or optionally bolts, which extend through the recess in the door and are connected to the mounting plate for a door handle assembly on the opposite side of the door.

The door handle assembly (not shown) is assembled correspondingly on the opposite side of the door and is placed in position on the door handle pin 14 before the mounting plate of the assembly is secured on the door; the door handle pin now connects the inner races of the two door handles so that these parts cannot rotate with respect to each other.

Instead of the locking ring 11, which is secured against rotation in the track 12, a circular plate with a mating hole 13 may be riveted or welded on the inner race 6 or be made integral with the inner race.

Instead of the threaded connection 3, 4 between the door handle 2 and the inner race, other connections may be provided, e.g. a bayonet coupling.

I claim:

1. A door handle assembly for use on one side of a door also having a door handle on the other side of the door, in which the assembly includes a door handle pivoted in a mounting plate, such as a door handle rosette, through a ball bearing, the outer race of the ball bearing being fixed to the mounting plate and an inner race of the ball bearing being threadably secured to the door handle, an inner end of the door handle bearing an external thread and having a cavity opening toward the other door handle for receiving a door handle pin therebetween, the door handle pin being nonrotatively secured to the door handle, the ball bearing and the outer race surrounding the inner race in circumferential arrangement, characterized in that the inner race of the ball bearing has an internal thread corresponding to the external thread of the door handle for securing the inner race to the door handle and wherein the assembly includes means for preventing rotation of said inner race with respect to the door handle pin, the door handle pin being slidable in said means.

2. The door handle assembly of claim 1 wherein said rotation preventing means comprises a fixing plate firmly secured to the inner race of the ball bearing and having a non-circular mating hole aligned with said cavity for slidably receiving the door handle pin therethrough.

3. The door handle assembly of claim 2 wherein the inner race of the ball bearing includes an annular ring with a plurality of grooves therethrough and the fixing plate is formed as a locking ring contained in said annular ring and having integral projections extending into the grooves.

* * * * *